US005564333A

United States Patent [19]

Palmer

[11] Patent Number: 5,564,333

[45] Date of Patent: Oct. 15, 1996

[54] SPRING BIASED FLYWHEEL

[76] Inventor: Russell W. Palmer, 5324 Edgewood St., Celina, Ohio 45822

[21] Appl. No.: 537,996

[22] Filed: Oct. 2, 1995

[51] Int. Cl.[6] ..... B30B 1/06

[52] U.S. Cl. ..... 100/282; 72/452.5; 192/18 A

[58] Field of Search ..... 100/282, 292; 192/18 A, 85 AA; 72/452.5

[56] References Cited

U.S. PATENT DOCUMENTS

| | | | |
|---|---|---|---|
| 4,095,523 | 6/1978 | Drungil | 100/282 |
| 4,533,029 | 8/1985 | Weber | 192/18 A |
| 4,550,814 | 11/1985 | Harry | 192/18 B |
| 4,589,533 | 5/1986 | Del Duca | 192/18 A |
| 4,709,794 | 12/1987 | Lengsfeld et al. | 192/18 B |
| 4,712,660 | 12/1987 | Erndt et al. | 192/18 B |
| 4,823,926 | 4/1989 | Wittler et al. | 192/18 B |
| 5,190,129 | 3/1993 | Sommer | 192/18 A |
| 5,226,516 | 7/1993 | Novikoff et al. | 192/70.28 |
| 5,370,045 | 12/1994 | Burns | 100/282 |

*Primary Examiner*—Stephen F. Gerrity
*Attorney, Agent, or Firm*—Randall J. Knuth

[57] ABSTRACT

A press including a flywheel which is axially shifted along the quill to which it is rotatably mounted from an idle position to an engaged position during engagement of the flywheel by the clutch connected to the press crankshaft, and which is axially biased to the idle position when the clutch is subsequently disengaged. The press includes a rigid drive disk, connected to the flywheel for rotation therewith, that is engaged by a clutch mechanism to drivingly couple the press crankshaft to the flywheel. The rigid drive disk and the flywheel are both axially shifted during clutch engagement. Spring elements between the quill or non-rotating press frame and the flywheel are compressed when the flywheel is so shifted, and these spring elements return or axially shift the flywheel and drive disk to an idle position when the clutch mechanism is subsequently disengaged.

21 Claims, 3 Drawing Sheets

SPRING BIASED FLYWHEEL

BACKGROUND OF THE INVENTION

The present invention pertains to mechanical presses, and, in particular, to a flywheel and clutch assembly used to selectively couple a rotating flywheel with a rotatable press crankshaft.

Mechanical presses such as straight side presses and gap frame presses for stamping and drawing operations include a frame having a crown and bed and a slide supported within the frame for reciprocating motion toward and away from the bed. The slide is typically driven by a crankshaft having a connecting arm connected to the slide, to which is mounted the upper die. Rotation of the crankshaft moves the connecting rods to effect straight reciprocating motion of the slide. The lower die is conventionally mounted to a bolster which, in turn, is connected to the bed. Such mechanical presses are widely used for blanking and drawing operations and vary substantially in size and available tonnage depending on their intended use.

The primary apparatus for storing mechanical energy in a press is the flywheel. The flywheel is usually mounted at one end of the crankshaft and connected by a belt to the output pulley of a motor such that when the motor is energized, the massive flywheel rotates continuously. The flywheel and flywheel bearing are normally axially mounted on either the driveshaft, crankshaft, or the press frame by use of a quill. The main drive motor replenishes the energy that is lost or transferred from the flywheel during press operations when the clutch engages the flywheel to transmit rotary motion of the flywheel to the crankshaft. During engagement of the clutch, the flywheel drops in speed as the press driven parts are brought up to press running speed.

In some presses, a flexible clutch plate with a drive disk is attached to the flywheel. A driven disk of the clutch mechanism is attached in a rotationally fixed manner to the crankshaft and may be selectively operated to engage the drive disk of the flywheel, thereby transferring rotational energy to the crankshaft. An improved design disclosed in U.S. Pat. No. 5,370,045 employs a flexible clutch plate between the drive disk and the flywheel, but the drive disk is mounted to the clutch plate to permit radial thermal expansion of the disk during use.

SUMMARY OF THE INVENTION

The present invention provides a press having a flywheel which is axially movable along the quill to which it is rotatably mounted. When a rigid drive disk connected to the flywheel is engaged by the clutch mechanism to drivingly couple the press crankshaft to the flywheel, the rigid drive disk and the flywheel are both axially shifted. Spring elements associated with the flywheel are compressed when the flywheel is so shifted, and these spring elements return or axially shift the flywheel and drive disk to an idle position when the clutch mechanism is subsequently disengaged. By providing an axially movable flywheel, a rigid drive disk can be used and the need for splines, keys and pins is advantageously avoided.

In one form thereof, the present invention provides a press including a frame structure with a crown and a bed, a slide guided by the frame structure for reciprocating movement in opposed relation to the bed, a drive mechanism attached to the frame structure, and a flywheel rotatably driven by the drive mechanism. The flywheel is mounted to the frame structure and is slidable along an axis of rotation between an idle position and an engaged position. The press also includes a crankshaft rotatably disposed within the crown and in driving connection with the slide, and a clutch assembly including a driven disk connected to the crankshaft to be rotatable therewith. The driven disk is movable between an engaged arrangement in operative engagement with the flywheel to produce crankshaft rotation and an idle arrangement, and movement of the driven disk from the idle arrangement to the engaged arrangement axially moves the flywheel from the idle position to the engaged position. The press also includes at least one biaser for axially returning the flywheel from the engaged position to the idle position when the driven disk moves from the engaged arrangement toward the idle arrangement.

In another form thereof, the present invention provides a mechanical press including a frame structure with a crown and a bed, a slide guided by the frame structure for rectilinear reciprocating movement in opposed relation to the bed, a crankshaft rotatably disposed within the crown and in driving connection with the slide, a quill axially mounted around the crankshaft and rotatably fixedly connected with the frame structure, a drive mechanism attached to the frame structure, and a flywheel rotatably driven by the drive mechanism. The flywheel is axially mounted to the quill with at least one bearing therebetween, and the flywheel is slidable along the quill between an idle position and an engaged position. The press also includes a drive disk connected to the flywheel for rotation therewith, and a clutch means, connected to the crankshaft, for selectively clamping the drive disk between a driven disk and a facing disk engaging member to cause the crankshaft to rotate with the flywheel. The clutch means includes an idle arrangement wherein the drive disk is disengaged from the driven disk and an engaged arrangement wherein the drive disk is frictionally engaged with the driven disk, and the drive disk moves from an idle position to an engaged position when the clutch means shifts from the idle arrangement to the engaged arrangement whereby the flywheel axially moves from the idle position to the engaged position. The press further includes at least one biaser for returning the flywheel from the engaged position to the idle position when the clutch means moves from the engaged arrangement toward the idle arrangement.

One advantage of the present invention is that the flywheel is axially movable such that a clamping clutch mechanism can be accommodated without requiring pins, splines or keys.

Another advantage of the present invention is that during braking of the rotation of the crankshaft, the flywheel is automatically returned to an idle position free from a frictional engagement with the clutch mechanism.

BRIEF DESCRIPTION OF THE DRAWINGS

The above mentioned and other advantages and objects of this invention, and the manner of attaining them, will become more apparent and the invention itself will be better understood by reference to the following description of embodiments of the invention taken in conjunction with the accompanying drawings, wherein.

Figure 1:
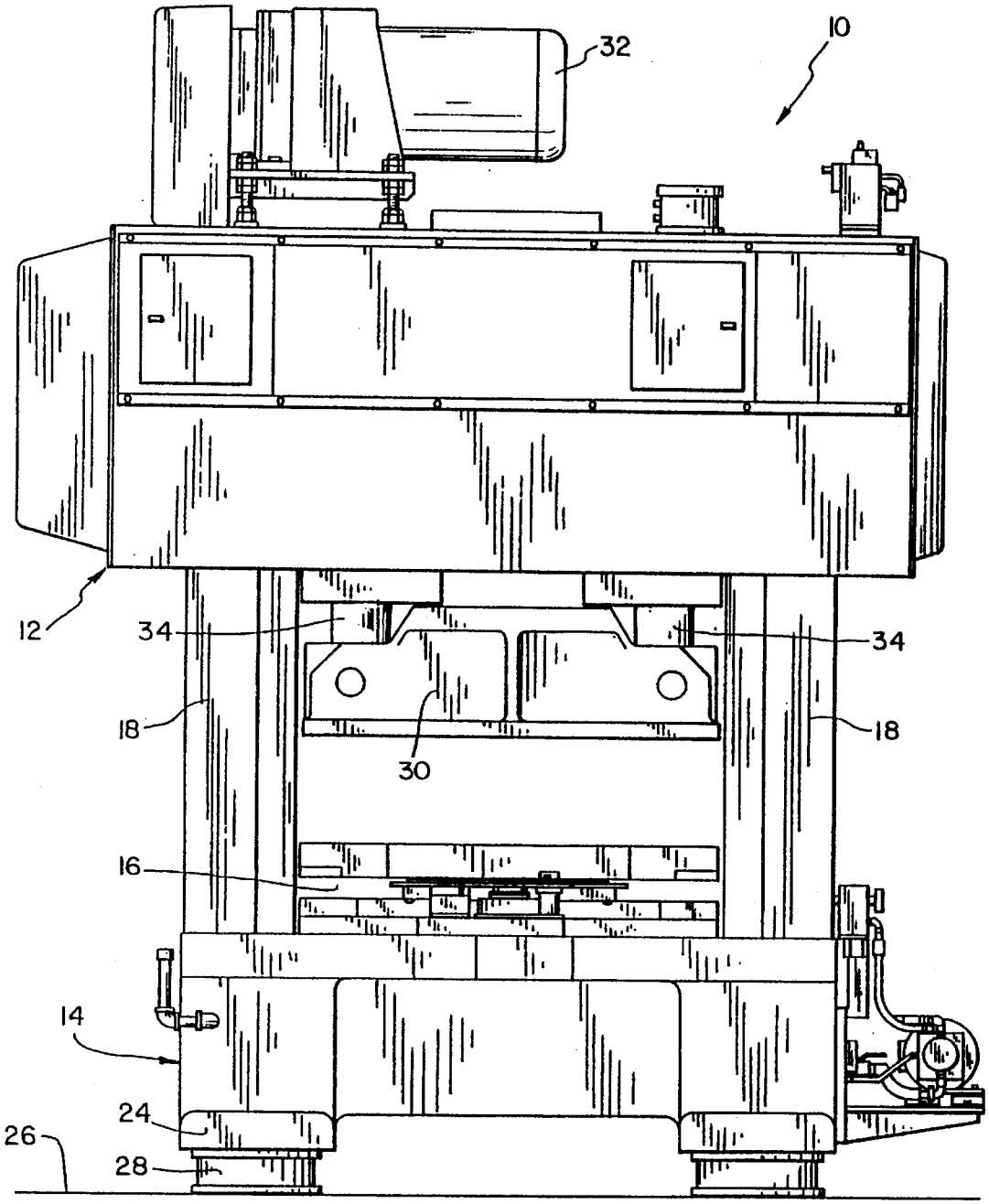
FIG. 1 is an elevational front view of one configuration of a mechanical press incorporating the present invention in one form thereof.

Corresponding reference characters indicate corresponding parts throughout the several views. Although the drawings represent embodiments of the invention, the drawings are not necessarily to scale and certain features may be exaggerated or omitted in order to better illustrate and explain the present invention.

DESCRIPTION OF THE PREFERRED EMBODIMENTS

Referring now to FIG. 1, there is shown one embodiment of a mechanical press, generally designated 10, which employs the present invention. As is conventional, press 10 includes a crown portion 12, a bed portion 14 having a bolster assembly 16 connected thereto, and uprights 18 connecting crown portion 12 with bed portion 14. Uprights 18 are connected to or integral with the underside of crown 12 and the upper side of bed 14. A slide 30 is positioned between uprights 18 for reciprocating movement. Tie rods (not shown), extending through crown 12, uprights 18 and bed portion 14, are attached at each end with tie rod nuts. Leg members 24 are formed as an extension of bed 14 and are generally mounted on shop floor 26 by means of shock absorbing pads 28. A drive mechanism for the press is shown as including a drive motor 32 attached by means of a belt to a flywheel. It will be appreciated in view of the following that the above description of the press and its drive mechanism is merely illustrative and is not intended to be limiting, as those of skill in the art will recognize that other known press and drive configurations can advantageously utilize the teachings of the present invention.

Figure 2:
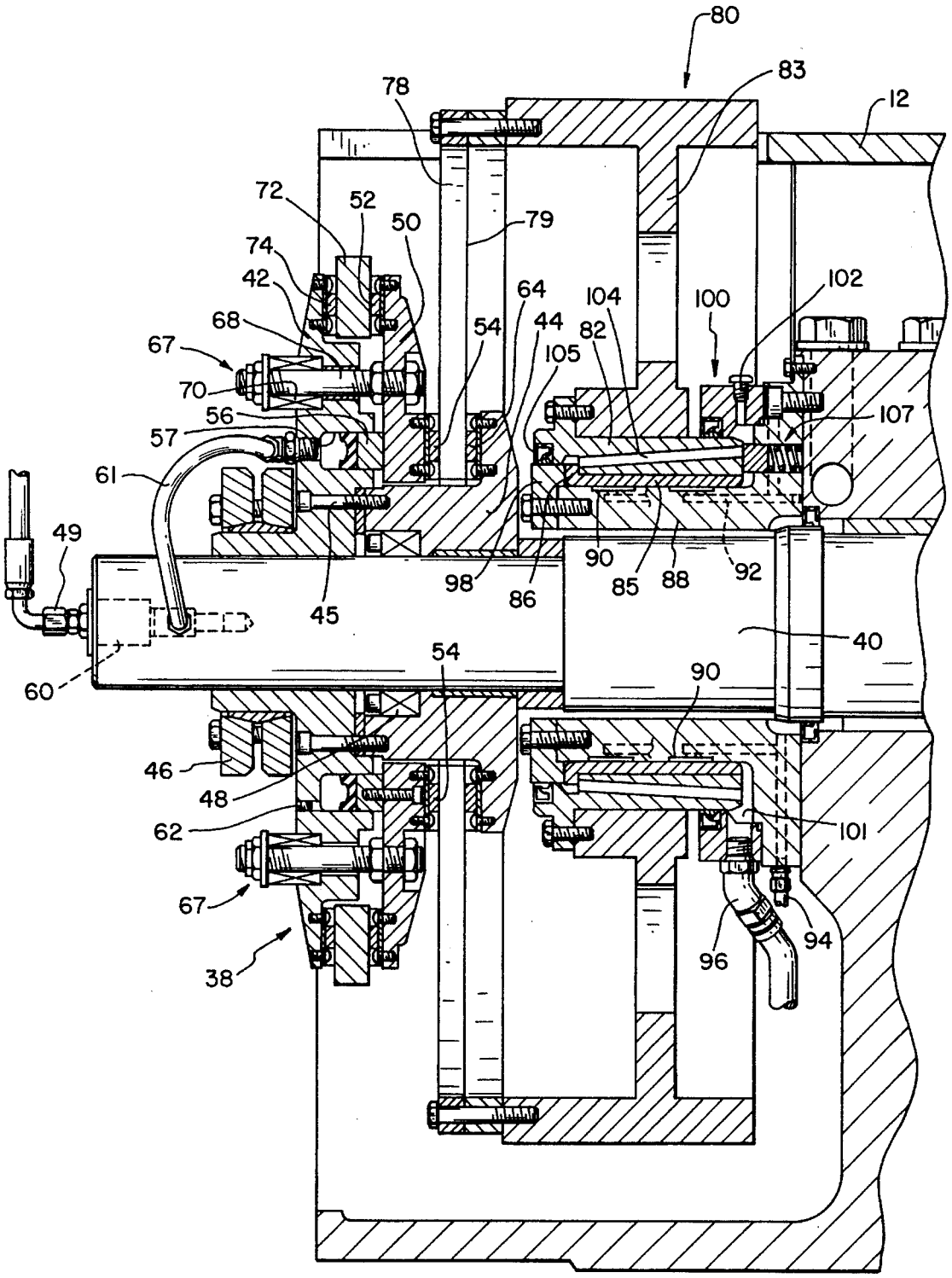
FIG. 2 is a fragmentary, vertical sectional view of the mechanical press of FIG. 1 illustrating one arrangement of the flywheel, the combination clutch/brake, and the press crankshaft.

Referring now to FIG. 2, there is shown a fragmentary, cross-sectional side view of the press of FIG. 1. Press crankshaft 40 is rotatably supported within crown portion 12 and extends in an axial direction. As is conventional, the portion (not shown) of crankshaft 40 further inward or to the right in FIG. 1 is connected to slide 30 by connecting rods to cause rotational energy of crankshaft 40 to be converted into reciprocating movement of slide 30. Proximate its outward end, or its left end in FIG. 2, crankshaft 40 has axially mounted thereto combination clutch/brake 38, which selectively allows for driving interconnection of crankshaft 40 with the rotating flywheel 80 as well as for braking of the crankshaft rotation. While illustrative of one type of clutch assembly and brake assembly suitable for use in the present invention, the described configuration of combination clutch/brake 38 is not intended to be limiting as other assemblies may be used within the scope of the invention.

In the shown embodiment, combination clutch/brake 38 includes piston housing 42 and clutch sleeve 44, which are connected together with bolts 45 and axially mounted on crankshaft 40. External ringfitter 46 clamps piston housing 42 onto crankshaft 40 to be rotatable therewith, and internal ringfitter 48 expands during installation to similarly lock clutch sleeve 44 to crankshaft 40 to prevent relative rotation therebetween.

Disposed inward of piston housing 42 and circumferentially around clutch sleeve 44 is an annular shaped stud plate 50 axially centered on crankshaft 40. Connected by bolts along the outer periphery of the outward face of stud plate 50 are multiple, circular segment facing elements 52 arranged in a ring shape. Along the inner periphery of the inward face of stud plate 50 and connected by bolts is a ring-shaped arrangement of clutch facings 54. Stud plate 50 functions within the clutch assembly as the driven disk and within the brake assembly as the braking disk as will be further described below.

Attached to the outward face of stud plate 50 is an annular shaped piston 56 which slidably fits within recess 57 of piston housing 42. Pressurized hydraulic fluid from a source on the press is routed through rotary union 49, through axial cavity 60 in the end of crankshaft 40, and through hydraulic line 61 into recess 57. When sufficient hydraulic pressure is supplied to recess 57, combination clutch/brake 38 acts as a clutch and the clutch assembly of this embodiment performs as follows. Due to the hydraulic pressure provided, piston 56 is driven inward, thereby causing stud plate 50 to be shifted axially inward such that clutch facings 54 frictionally engage drive disk 78. When engaged, drive disk 78 is pushed axially inward as will be further explained below such that the inward face 79 of disk 78 frictionally engages an outwardly facing, ring-shaped arrangement of clutch facings 64 bolted to an annular shoulder of axially stationary clutch sleeve 44. This gripping of drive disk 78 between clutch facings 54, 64 results in the transfer of torque from drive disk 78 to stud plate or driven disk 50 and clutch sleeve 44 to thereby rotate crankshaft 40. A bleeder valve abstractly shown at 62 ports into recess 57 to permit bleeding of entrapped air within the hydraulic system.

The brake components of combination clutch/brake 38 which serve to selectively stop rotation of crankshaft 40 include multiple brake spring stud assemblies 67 at spaced angular intervals which axially extend through piston housing 42. Stud assemblies 67 include studs 68, which are fixedly connected to stud plate 50 and biased outward by coil springs 70. Coil springs 70 are designed to axially bias stud plate 50 such that facing elements 52 contact brake member 72 when hydraulic pressure within recess 57 is reduced to disengage the clutch assembly. In a not shown manner well known in the art, brake member 72 is keyed to crown 12 of press 10 so as to be axially slidable but rotatably fixed. As a result, when frictionally engaged by facing elements 52, brake member 72 slides outwardly and is pressed against a ring-shaped arrangement of brake facing elements 74 mounted on piston housing 42 in opposed relationship with facing elements 52. The gripping or clamping of brake member 72 therebetween thereby accomplishes the braking function for the shown assembly.

Figure 3:
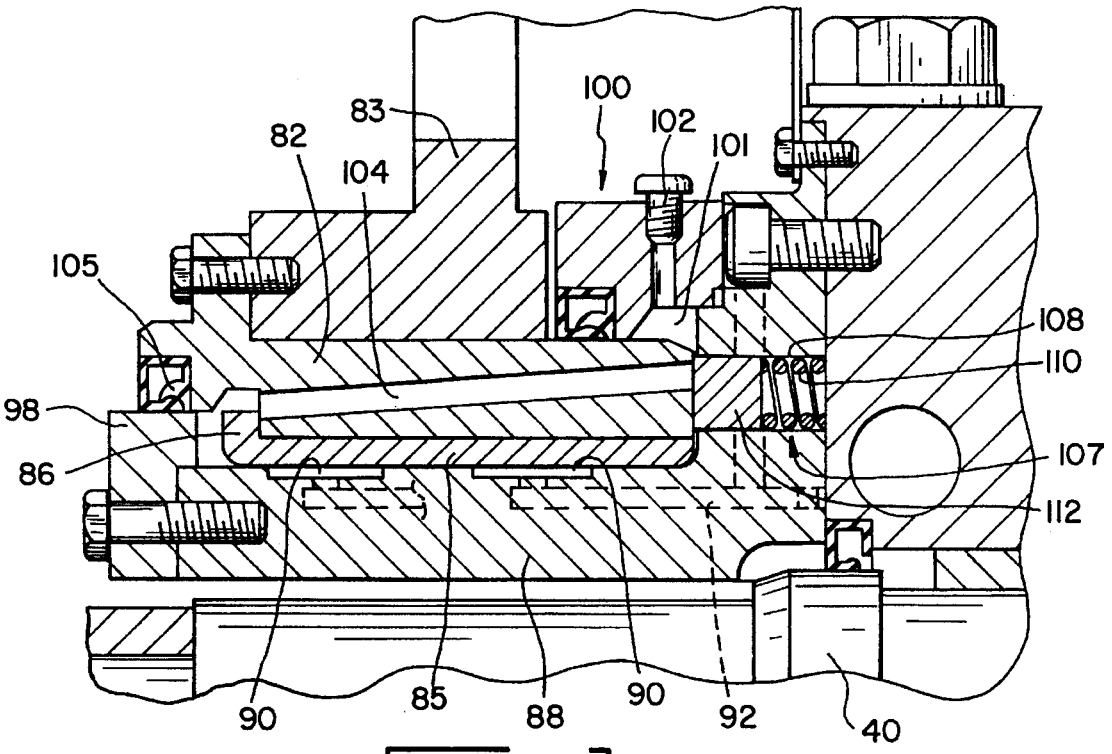
FIG. 3 is an enlarged view of a portion of FIG. 2 further illustrating the flywheel assembly and one of the flywheel biasers after the clutch assembly has been actuated to operatively engage the flywheel.

As shown in FIG. 2, and with additional reference to FIG. 3 where a portion of the flywheel assembly is shown enlarged and in a clutch engaged position, the flywheel assembly includes a flywheel, generally designated 80, formed of an integral web and peripheral mass section 83 and a hub portion 82 bolted thereto. Alternatively, the flywheel could be integrally formed.

Attached to flywheel 80 is a rigid clutch plate or drive disk 78 frictionally engagable by the clutch assembly of combination clutch/brake 38. Drive disk 78 is fixedly connected to peripheral mass section 83 by multiple bolts circumferentially spaced around the disk outer periphery. When operationally installed and when the flywheel assembly and the clutch assembly are disposed in the idle position shown in FIG. 2, the inner periphery of drive disk 78 is situated with a backside running clearance of about 0.030 inch from clutch facings 64 and a running clearance of about 0.030 inch from stud plate clutch facings 54. Although shown being solid in construction, drive disk 78 may be alternatively configured, including a laminate construction. Furthermore, while drive disk 78 may be perfectly rigid such that no measurable flexure occurs during operational loadings, a degree of flexure in the rigid plate is preferably provided to optimize the performance and wear caused by repeated engagements.

Flywheel 80, which is attached to the drive mechanism by means of a belt (not shown), is rotatable about a quill 88. A crown on the flywheel keeps the belt in a proper arrangement during axial movement of the flywheel. Crankshaft 40 axially extends through quill 88 and is rotatable relative thereto. Quill 88 is bolted to the press frame, and more particularly in the shown embodiment to crown portion 12.

The bearing assembly between flywheel 80 and quill 88 is generally described in U.S. patent application Ser. No. 08/271,762, which is incorporated herein by reference, and includes a bronze bushing 85 attached to flywheel hub 82. Multiple hydrostatic pad areas 90 formed on the cylindrical exterior surface of quill 88 are supplied with oil through conduits 92 within quill 88 connected to external lines at 94 fed from a orifice connected to a pressurized oil reservoir. Hydrostatic bearing pads 90 provide sufficient lubrication and load supporting characteristics to allow relative rotation between flywheel 80 and quill 88, and further allow axial movement of flywheel 80 and bushing 85 along quill 88.

In operation, fluid delivered to pad areas 90 flows axially inward and outward between quill 88 and bushing 85. Oil at the inward end of bushing 85 flows into annular fluid space 101 and into drain hose 96. An annular, inward seal assembly 100 attached to quill 88 seals oil within fluid space 101 such that the oil therein passes through drain hose 96 to a reservoir for recirculation. At its top portion, seal assembly 100 is shown including a breather vent 102 and could alternatively be provided with a vacuum drain. Oil at the outward end of bushing 85 flows upwardly past annular lip 86, into multiple fluid collection channels 104 extending through flywheel hub 82 at angular intervals around the hub, and into fluid space 101 and then drain hose 96. As shown in FIG. 2, when the flywheel assembly is disposed in the outward or idle position, annular lip 86 abuts retainer ring 98 bolted to the outward end of quill 88. Radial grooves (not shown) in the outward face of annular lip 86 allow oil to pass bushing 85 when the flywheel assembly is so disposed. Seal 105 interfits between flywheel hub 82 and retainer ring 98 to prevent oil leakage.

Interposed between flywheel hub 82 and quill 88 are a number of biasers, generally designated 107, which bias the flywheel assembly toward an idle position. In the cross-section of FIG. 2, one biaser is visible. With reference to FIG. 3, in this embodiment biaser 107 includes a cylindrical, axially aligned bore 108 in quill 88 that receives a helical compression spring 110. A steel piston or plunger 112 slidably fits within bore 108, and the outward face of piston 112 abuts the inward face of flywheel hub 82. The sliding engagement of piston 112 with hub 82 during flywheel rotation is splash lubricated by the oil flowing from the hydrostatic bearing pads. Although shown blocking a collection channel 104, it will be appreciated that piston 112 will block channel 104 only temporarily as rotation of flywheel 80 will take channel 104 out of alignment with the non-rotating biaser 107 such that oil may be exhausted from channel 104 into fluid space 101.

In a preferred embodiment, three biasers 107 are utilized, and the biasers are provided at 120° intervals around quill 88 to supply a balanced flywheel returning force. Other numbers and constructions of the biasing components, for example a hydraulic cylinder actuator or wherein the spring element comprises an elastomeric material rather than a coil spring, may naturally be provided within the scope of the invention. In addition, the biasers need not interposed between the flywheel and quill, but rather could be alternatively situated to achieve the proper returning force on the flywheel assembly or drive disk relative to crown portion 12.

The construction of biasers 107 will be further understood in view of their operation. Initially, the flywheel assembly and combination clutch/brake 38 are arranged in the idle position shown in FIG. 2 whereby flywheel 80 rotates independently of the braked crankshaft 40. When the clutch is activated in order to bring crankshaft 40 up to speed with flywheel 80, as described above stud plate 50 is shifted to the right to clamp drive disc 78 between clutch facings 54, 64. During its clamping, drive disc 78 is axially shifted to the right in the Figures to close out the running clearance. Due to the rigid construction of drive disc 78 and its attachment with flywheel 80, the flywheel assembly consequently axially slides along the oil film supplied by the hydrostatic bearings. It will be appreciated that the axial gap shown in FIG. 2 between the inward end of bushing 85 and the radially aligned face of quill 88 is equal to the running clearance of the drive disk plus a suitable side clearance of the bushing which may account for wear of the components and flexure of the drive disk. The returning force provided by biasers 107 is not sufficient to prevent this flywheel axial motion, and as the flywheel shifts to the right, pistons 112 are forced into bores 108 and thereby compress their respective coil springs 110. At this point in operation, during which the flywheel is driving the rotation of crankshaft 40, the flywheel assembly is disposed in an engaged position shown in FIG. 3.

When combination clutch/brake 38 is subsequently actuated to brake crankshaft 40, stud plate 50 axially moves to the left as described above, thereby disengaging or unclamping drive disk 78. Biasers 107 then extend and force flywheel 80, and thereby drive disk 78, axially outward from the engaged position toward the idle position shown in FIG. 2. The flywheel assembly slides along the oil film of the hydrostatic bearings until the annular lip 86 of bushing 85 abuts retainer ring 98, which thereby prevents further axial movement of the flywheel assembly. Drive disk 78 is particularly designed with respect to the flywheel assembly such that when bushing 85 is in flush relationship with retainer ring 98, drive disk 78 is centered between clutch facings 54, 64 and with appropriate running clearances in preparation for the next clutch actuation.

While this invention has been described in the context of a preferred embodiment, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A press comprising:

a frame structure with a crown and a bed;

a slide guided by the frame structure for reciprocating movement in opposed relation to said bed;

a drive mechanism attached to said frame structure;

a flywheel rotatably driven by said drive mechanism, said flywheel mounted to said frame structure and slidable along an axis of rotation thereof between an idle position and an engaged position;

a crankshaft rotatably disposed within said crown and in driving connection with said slide;

a clutch assembly including a driven disk connected to said crankshaft to be rotatable therewith, said driven disk movable between an engaged arrangement in operative engagement with said flywheel to produce crankshaft rotation and an idle arrangement, wherein movement of said driven disk from said idle arrangement to said engaged arrangement axially moves said flywheel from said idle position to said engaged position; and at least one biaser for axially returning said flywheel from said engaged position to said idle position when said driven disk moves from said engaged arrangement toward said idle arrangement.

2. The press of claim 1 wherein said at least one biaser comprises a piston and a spring element interposed between said frame structure and said flywheel.

3. The press of claim 2 further comprising a quill axially mounted on said crankshaft and attached to said frame structure, wherein said flywheel is rotatably mounted to said quill with at least one bearing therebetween, and wherein said quill comprises a bore in which said biaser piston reciprocates.

4. The press of claim 2 wherein said at least one biaser is rotationally fixed and said piston slidably engages said flywheel.

5. The press of claim 1 wherein said at least one biaser is spring biased.

6. The press of claim 1 wherein said at least one biaser comprises a plurality of biasers angularly spaced around said flywheel axis of rotation.

7. The press of claim 6 wherein said flywheel comprises a hub, and wherein said plurality of biasers comprises three rotationally fixed biasers positioned approximately 120° apart and for engagement with said hub.

8. The press of claim 1 further comprising a quill axially mounted on said crankshaft and attached to said crown, wherein said flywheel is rotatably mounted to said quill with at least one bearing therebetween, and wherein said at least one bearing comprises hydrostatic bearing pad means.

9. The press of claim 1 further comprising a drive disk connected to said flywheel for rotation therewith, wherein said clutch assembly further comprises a disk engaging member arranged in facing relationship with said driven disk, wherein said drive disk projects between said driven disk and said disk engaging member, and wherein said drive disk is clamped between said driven disk and said disk engaging member when said driven disk moves from said idle arrangement to said engaged arrangement.

10. The press of claim 9 wherein an inner radial portion of said drive disk is clamped between said driven disk and said disk engaging member.

11. The press of claim 1 further comprising means for braking crankshaft rotation, and wherein said clutch assembly and said braking means comprise a combination clutch/brake.

12. A mechanical press comprising:

a frame structure with a crown and a bed;

a slide guided by the frame structure for reciprocating movement in opposed relation to said bed;

a drive mechanism attached to said frame structure;

a flywheel rotatably driven by said drive mechanism, said flywheel mounted to said frame structure and slidable along an axis of rotation between an idle position and an engaged position;

a drive disk connected to said flywheel for rotation therewith;

a crankshaft rotatably disposed within said crown and in driving connection with said slide;

a clutch assembly connected to said crankshaft, said clutch assembly movable between an engaged arrangement in frictional connection with said drive disk to produce crankshaft rotation and an idle arrangement, wherein movement of said clutch assembly from said idle arrangement to said engaged arrangement causes axial movement of said drive disk and axial movement of said flywheel from said idle position to said engaged position; and at least one biaser for returning said flywheel from said engaged position to said idle position when said clutch assembly moves from said engaged arrangement toward said idle arrangement.

13. The mechanical press of claim 12 wherein said at least one biaser comprises a plurality of biasers.

14. The mechanical press of claim 12 wherein said at least one biaser comprises a piston and a spring element interposed between said crown and said flywheel.

15. The mechanical press of claim 12 wherein said clutch assembly further comprises a clutch sleeve mounted on said crankshaft and including a disk engaging member arranged in facing relationship with said driven disk, wherein said drive disk is interposed between said driven disk and said disk engaging member, and wherein said driven disk is moved toward said disk engaging member when said clutch assembly moves from said idle arrangement to said engaged arrangement to clamp said drive disk between said driven disk and said disk engaging member.

16. The mechanical press of claim 12 wherein said drive disk comprises a rigid, one-piece construction.

17. The mechanical press of claim 12 further comprising a quill axially mounted on said crankshaft and rotationally fixedly connected with said frame structure, and wherein said flywheel is axially mounted to said quill with at least one bearing therebetween, said flywheel being slidable along said quill between said idle position and said engaged position.

18. The mechanical press of claim 17 wherein said at least one bearing comprises a hydrostatic bearing pad means.

19. The mechanical press of claim 17 wherein said at least one biaser comprises a piston and a spring element, and wherein said quill comprises a bore in which said biaser piston reciprocates.

20. A mechanical press comprising:

a frame structure with a crown and a bed;

a slide guided by the frame structure for rectilinear reciprocating movement in opposed relation to said bed;

a crankshaft rotatably disposed within said crown and in driving connection with said slide;

a quill axially mounted on said crankshaft and rotationally fixedly connected with said frame structure;

a drive mechanism attached to said frame structure;

a flywheel rotatably driven by said drive mechanism, said flywheel axially mounted to said quill with at least one bearing therebetween, said flywheel being slidable along said quill between an idle position and an engaged position;

a drive disk connected to said flywheel for rotation therewith;

a clutch means, connected to said crankshaft, for selectively clamping said drive disk between a driven disk and a facing disk engaging member to cause said crankshaft to rotate with said flywheel, wherein said clutch means comprises an idle arrangement wherein said drive disk is disengaged from said driven disk and an engaged arrangement wherein said drive disk is frictionally engaged with said driven disk, and wherein said drive disk moves from an idle position to an engaged position when said clutch means shifts from said idle arrangement to said engaged arrangement whereby said flywheel axially moves from said idle position to said engaged position; and at least one biaser for returning said flywheel from said engaged position to said idle position when said clutch means moves from said engaged arrangement toward said idle arrangement.

21. The mechanical press of claim 20 wherein said at least one bearing comprises at least one hydrostatic bearing pad.

* * * * *